United States Patent [19]

Hartley

[11] Patent Number: 4,690,445

[45] Date of Patent: Sep. 1, 1987

[54] SECURITY STRIKER PLATE

[76] Inventor: Richard A. Hartley, 25834 Continental Cir., Taylor, Mich. 48180

[21] Appl. No.: 866,748

[22] Filed: May 27, 1986

[51] Int. Cl.[4] ..... E05B 15/02; E05B 17/00; E05C 1/04; E05C 19/06

[52] U.S. Cl. ..... 292/341; 292/346; 292/87; 292/147

[58] Field of Search ..... 292/346, 341, 340, 145, 292/147, 150, 341.15, 37, 42

[56] References Cited

U.S. PATENT DOCUMENTS

| | | | |
|---|---|---|---|
| 1,245,049 | 10/1917 | Silverstein . | |
| 1,579,139 | 3/1926 | Phillips | 292/346 X |
| 1,844,459 | 2/1932 | Brandon . | |
| 3,815,945 | 6/1974 | Lamphere | 292/340 |
| 3,858,917 | 1/1975 | Nahon | 292/57 |
| 4,005,890 | 2/1977 | Murch | 292/346 |
| 4,021,880 | 5/1977 | Murphy | 292/340 |
| 4,074,484 | 2/1978 | Queren | 292/346 X |
| 4,126,343 | 11/1978 | Ragland | 292/341 |
| 4,171,837 | 10/1979 | McRoy | 292/346 |
| 4,174,862 | 11/1979 | Shane | 292/340 X |
| 4,195,870 | 4/1980 | Percoco | 292/340 |
| 4,341,408 | 7/1982 | Blevins | 292/150 |
| 4,383,709 | 5/1983 | Ronan | 292/346 |
| 4,474,394 | 10/1984 | Crepinsek | 292/340 |

FOREIGN PATENT DOCUMENTS

| | | | |
|---|---|---|---|
| 3144967 | 5/1983 | Fed. Rep. of Germany | 292/340 |
| 411707 | 4/1910 | France | 292/150 |
| 46970 | 10/1939 | Netherlands | 292/340 |
| 434924 | 9/1935 | United Kingdom | 292/147 |
| 658035 | 10/1951 | United Kingdom | 292/340 |
| 721407 | 1/1955 | United Kingdom | 292/340 |

OTHER PUBLICATIONS

Publication entitled "How to Protect Your Home", Consumer Reports, Oct. 1984, pp. 554–563.

*Primary Examiner*—Gary L. Smith
*Assistant Examiner*—Carl M. DeFranco, Jr.
*Attorney, Agent, or Firm*—Cullen, Sloman, Cantor, Grauer, Scott & Rutherford

[57] ABSTRACT

A security striker plate mounted with the rail of a door frame which includes a peripheral door stop and interior framing studs. The striker plate comprises a mount plate inset within the rail against an inner surface and secured thereto by a plurality first wood screws extending into the studs. A right angular apertured strike plate bears against a right angular surface of the rail and is secured thereto by a plurality of spaced second screws which extend into the studs. A right angular door stop lip extends from the strike plate to reinforce the door stop and a right angular anchor plate extends from the lip and bears against outer portions of the rail and is secured thereto by a plurality of tamper proof security screws which extend into the studs. The hook plate is secured to the studs and has apertures therethrough to supportively receive the second and third screws. The striker plate attachment to the framing in the exterior wall adjacent to door jamb deters the rail and the door therein from being kicked in.

11 Claims, 7 Drawing Figures

SECURITY STRIKER PLATE

FIELD OF THE INVENTION

The present invention relates to an improvement in strike plate construction which is attached to the framing members of the exterior wall in lieu of the door frame to deter unauthorized entry.

BACKGROUND OF THE INVENTION

The striker plate in typical homes normally do not pose a real deterent to unauthorized entry. Unauthorized entry can be achieved by kicking the door and splitting the door jamb, or dislodging the striker plate or prying the door and jamb apart to disengage the door latch from the striker plate or cutting the door latch with loose fitting doors and jambs or those that can be pried apart.

While many weaknesses in door locks pertain to the nature of the locking member upon the door and the ease with which the lock can be picked, wrenched or hammered, the existing problem relates to the inherent weakness of current door frames by which kicking or using a jimmy or other crow bar or tool, the door frame can be pried or separated from the door sufficiently to disconnect or cut the bolt latch from the jamb or rail to permit unauthorized entry.

Often the conventional strike plate provides very little protection against access to the strike plate with a tool or with a saw which may sever the deadbolt or latch bolt or will retract or sufficiently bend the anchoring screws which are of not sufficient length or anchorage to resist much exterior force. Heretofore in door frame constructions, the frame itself is inherently weak, particularly so at the location of the strike plate rendering the door vulnerable to exterior assault and tampering to obtain illegal access by forced opening of the door.

Standard striker plates are of such construction as to provide mechanical access to the interior of the latching mechanism and to the strike plate such as will permit the application of a prying tool thereinto or a crow bar or a saw or other tool such as will destroy the door locks or at least render them ineffective.

Various means have been employed to try to protect door frames and door lock sets and striker plates to be less vulnerable to intruders.

THE PRIOR ART

Strike plates are shown in one or more of the following patents:

| Patent No. | Patentee | Date |
|---|---|---|
| 1,245,049 | M. L. Silverstein | 10/30/17 |
| 1,844,459 | J. R. Brandon | 2/9/32 |
| 3,815,945 | Lamphere | 6/11/74 |
| 4,021,880 | Murphy | 5/10/77 |
| 4,383,709 | Ronan | 5/17/83 |
| 4,474,394 | Crepinsek | 10/2/84 |

SUMMARY OF THE INVENTION

It is an object of the present invention to provide an improved security strike plate assembly which is attached to framing members of exterior wall adjacent to door jamb and deters the door from being kicked in and otherwise armors and protectively encloses vital parts of the locking mechanism for the door.

An important feature is to provide a security striker plate for a door which is mounted within a cut away portion of the door jamb thereof, and wherein a series of fastener screws are employed which project through portions of the unit strike plate and into interior 2" by 4" studs for firm and effective anchorage of the striker plate to the framing members of the exterior wall.

An important feature is to provide an improved security strike plate for the locking means upon a door which is hinged within a door jamb including an upright rail, a peripheral door stop and interior framing studs such that when the unit striker plate is suitably mounted upon a cut away portion of the rail forming a part of the door frame, it is anchored and affixed by long screws which extend directly into the interior studs for a positive anchoring and securing of the security striker plate in position.

It is another feature to provide an improved security striker plate which reinforces the door frame and rail, particularly at the locking assembly, such as a latch bolt and deadbolt are mounted upon the door such as will protect the door from tampering and particularly destruction of the locks or prying of the frame away from the door to disengage the deadbolt or latch bolt from the striker plate.

It is another feature to provide in conjunction with the security striker plate an elongated apertured mount plate adapted to be inset and to bear against an interior surface of the rail and secured thereto by a series of screws which extend therethrough and into the studs. The mount plate terminates in a right angular apertured strike plate which bears against a right angular surface of the rail facing the door, when closed, and is secured to the rail by a plurality of additional screws which extend therethrough and into the studs.

A further feature includes upon the strike plate an outwardly extending right angular door stop lip which is in registery with and reinforces the existing door stop adapted to receive the door when closed from the inside of the building. A right angular anchor plate projects from the door stop lip and registers with an outer portion of the rail and is secured thereto by a plurality of tamper proof screws which extend through the anchor plate and are threaded snugly into the studs.

An important feature includes in conjunction with the first, second and third sets of screws for fastening the striker plate to the framing members of the exterior wall by anchorage to the exterior studs the use of a hook plate which is mounted upon the exterior stud which is suitably apertured to supportably receive and reinforce the second and third sets of fasteners which mount the striker plate to the framing members of the exterior wall, and to prevent their bending.

An important feature includes the formation as a part of the striker plate of one or a pair of parallel unit fins which extend rearwardly of the strike plate and anchor plate and are located so as to protectively enclose the respective anchoring screws against tampering from the outside.

As another feature, there is provided upon the security striker plate upon its mount plate a reciprocal deadbolt which is interlocked therewith and which is manually slidable between a retracted and advanced position where it extends over portions of the closed door to further retain the door closed and prevent unauthorized entry.

A further feature of the present invention is to provide an improved method of installing a security strike plate within the rail of a door frame, includes the steps of cutting out an enlarged opening within the door frame, adjacent internal studs therein and positioning a unit formed security striker plate within the cutout opening so that the mount plate portion thereof bears against an interior portion of the door frame and a strike plate portion bears against the right angular surface of the frame and an anchor plate portion bears against an exterior surface of the door frame and thereafter successively projecting first, second and third sets of wood screws through the respective mount plate, strike plate and anchor plate for projection into the studs for securing the striker plate firmly thereto, reinforcing the rail and preventing the striker plate from being dislodged by a force which could normally be exerted such as a kick to the door.

These and other objects and features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 2:
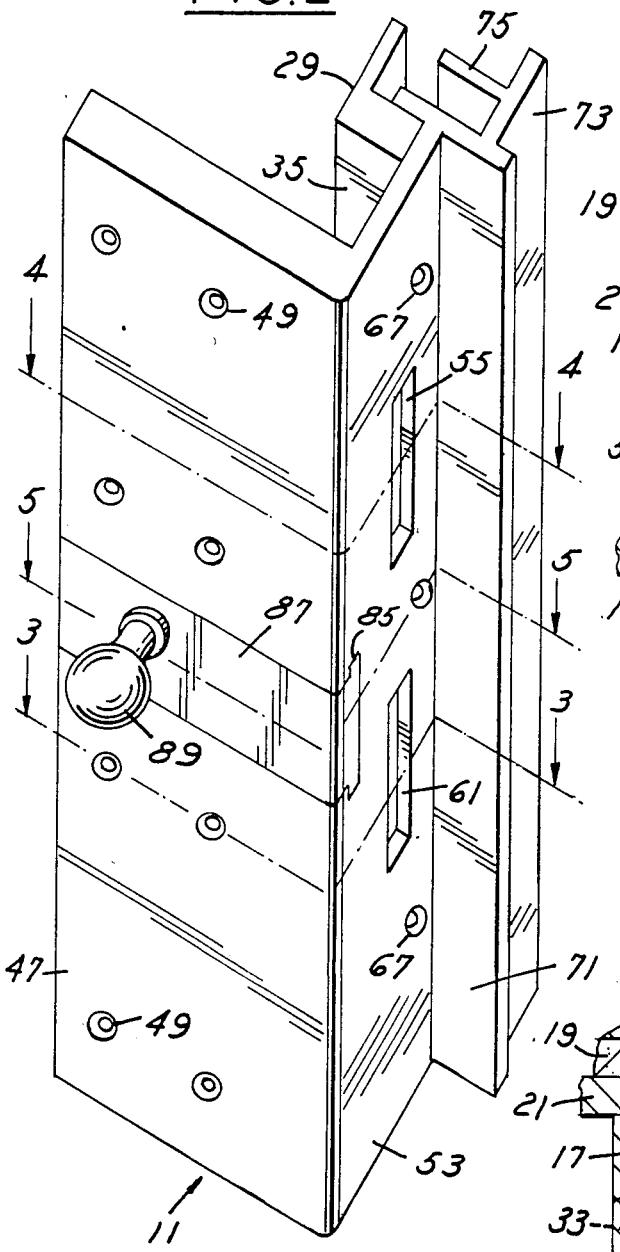
FIG. 2 is a front perspective view of the present security striker plate showing the positioning of the hook plate used therewith, on an increased scale.

Referring to the drawings, the present door frame security striker plate is generally designated at 11 in a perspective view, FIG. 2. It is constructed of an extruded aluminum in the preferred embodiment and is mountable within outer door jamb 13 and inner door jamb 15, FIGS. 3, 4 and 5.

Figure 1:
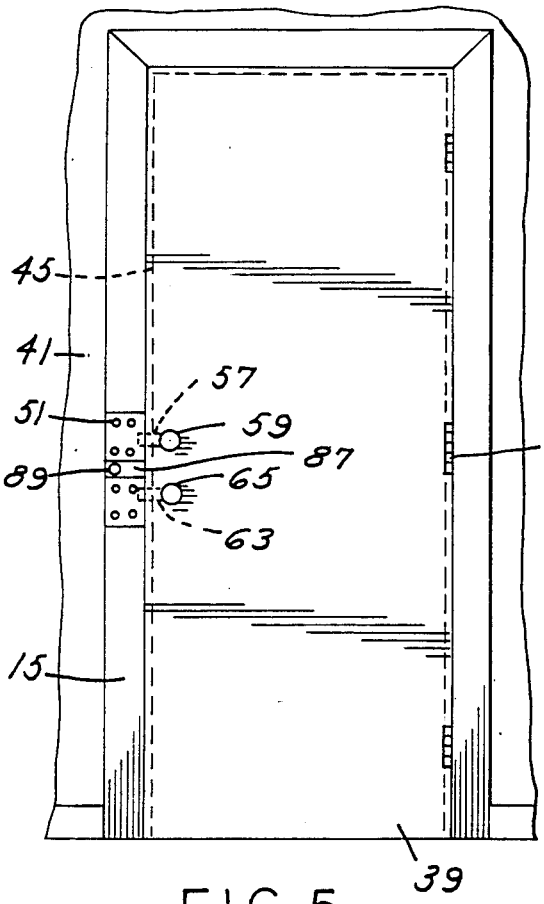
FIG. 1 is a fragmentary interior elevationl view of the present security striker plate as mounted within and upon the rail of a door frame with a door hinged therein.

The present security striker plate 11 is adapted for a locking means upon a door 39, FIG. 1, which is hinged at 43 within door jamb 13, 15, including the upright rail on one side of the door jamb. The door jamb or frame includes a peripheral door stop 45, shown in dash lines in FIG. 1, and a pair of adjacent upright framing studs 17, FIGS. 3, 4 and 5.

Figure 5:
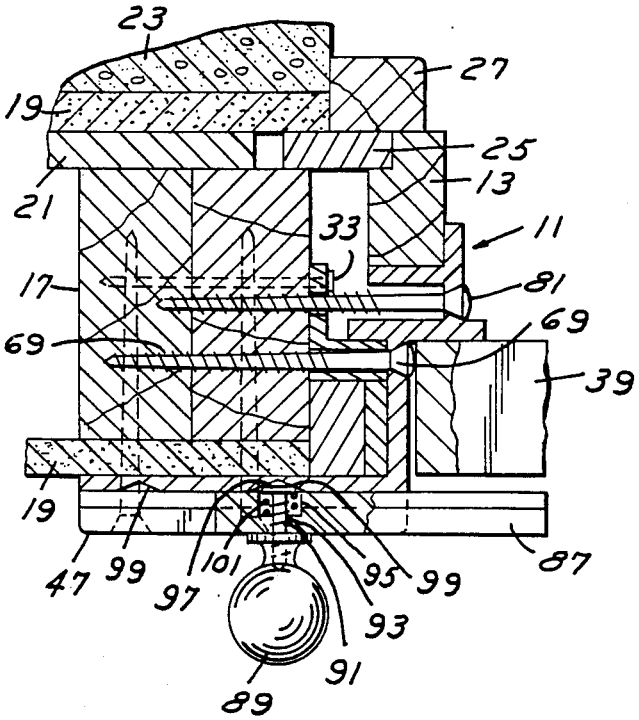
FIG. 5 is a fragmentary plan section taken in the direction of arrows 5—5 of FIG. 2.
Figure 3:
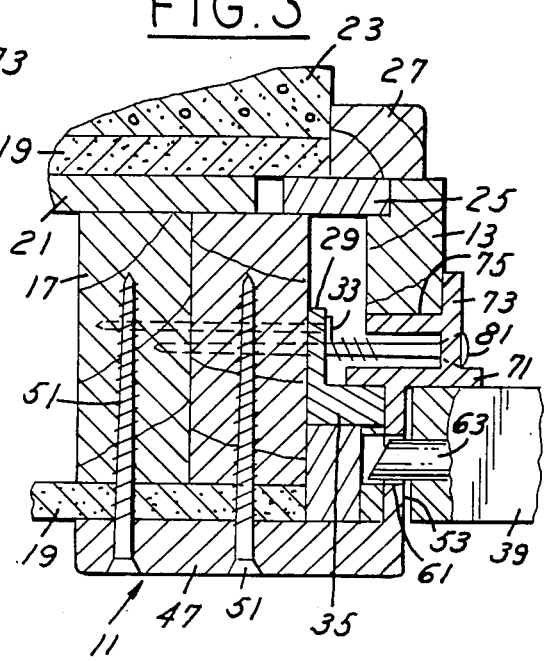
FIG. 3 is a fragmentary plan section taken in the direction of arrows 3—3 of FIG. 2.
Figure 4:
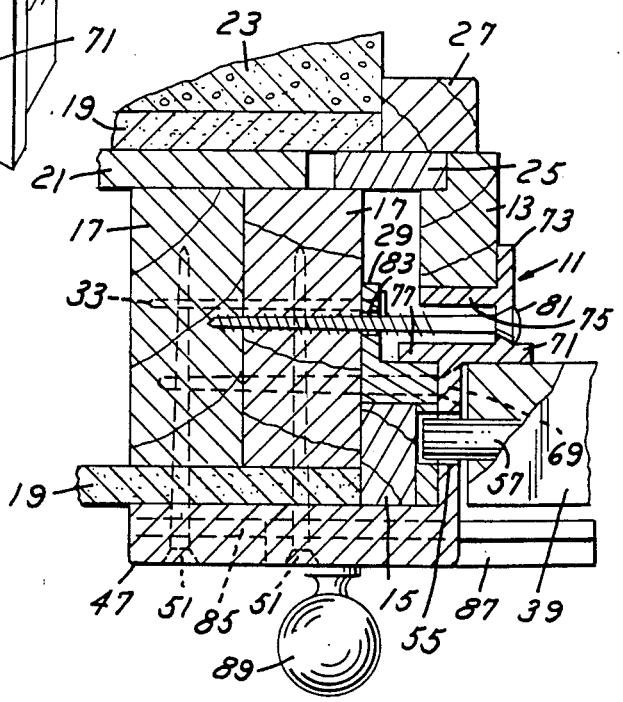
FIG. 4 is a fragmentary plan section taken in the direction of arrows 4—4 of FIG. 2.

The basic assembly for the door jamb for a building construction as in FIGS. 3, 4 and 5, includes dry wall 19, Celotex (TM) or other insulation 21, fragmentarily shown and a suitable veneer such as brick veneer 23, fragmentarily shown. Overlapping one of the studs 17 and extending outwardly thereof is the elongated, upright nailing strip 25 to which the outer door jamb 13 is suitably secured. The assembly is completed on the exterior of the upright wood molding 27.

Figure 7:
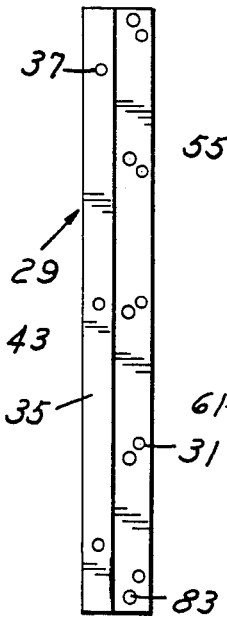
FIG. 7 is a front elevational view of the hook strip shown in FIG. 2.

Elongated upright hook strip 29 is of L shape in plan, FIGS. 2, 3, 4 and 5, has a series of transverse nail holes 31 therein, FIG. 7 and is suitably anchored to stud 17 by a plurality of nails 33. In the preferred embodiment, the stud are 2×4's. Hook strip 29 includes right angular spacer flange 35 having a series of spaced apertures 37, FIG. 7, adapted to receive fasteners 69 for anchoring the frame security striker plate 11 to the door jamb assembly.

Door 39 shown in elevation FIG. 1 and fragmentarily shown in FIGS. 3, 4 and 5, is positioned within frame 13, 15 in building wall 41, fragmentarily shown, and is hinged within the door frame at 43 which includes peripheral door stop 45.

The present door frame security striker plate 11 includes an elongated mount plate 47, FIG. 2, having a series of longitudinally spaced counter sunk apertures 49 arranged in a pair of laterally spaced rows adapted to receive the slotted head wood screws 51, FIGS. 3, 4 and 5. In the illustrative embodiment the screws are approximately 4" lone and are adapted to extend a substantial distance into the respective 2×4's 17, sometimes referred to as studs.

Mount plate 47 at its foward edge terminates in a right angular strike plate 53 which is adapted to bear against an intermediate portion of the door jamb 13, 15, or rail and includes upper deadbolt aperture 55 and lower latch bolt aperture 61.

Deadbolt aperture 55 is adapted to receive deadbolt 57, fragmentarily shown in FIG. 4, as extending from the mortise cylinder lock 59 upon door 39 of FIG. 1. Latch bolt aperture 61 is adapted to receive latch bolt 63, fragmentarily shown in FIG. 3, sometimes referred to as a security bolt latch, extends from and is controlled by the mortise cylinder lock 65 mounted upon door 39 in FIG. 1.

Upon one side of strike plate 53 which forms a part of the present security strike plate 11 are a series of longitudinally spaced counter sunk apertures 67 adapted to receive the elongated safety screws 69 which are 3 to 4" long. The screws 69 extend through the corresponding apertures 37 within hook plate 29 and are threaded into the respective 2×4's 17, FIGS. 3, 4 and 5.

Strike plate 53 upon one side terminates in the right angular door engaging lip 71 which is approximately 1" wide and as assembled registers within the continuous door stop 45, FIG. 1. Forming a part of security striker plate 11, and projecting from lip 71 is the upright anchor plate 73 which overlies a portion of outer door jamb 13 and is suitably secured thereto.

For this purpose, a plurality of safety screws 81, sometimes referred to as tamper proof security screws, extend through apertures 83 of hook strip 29 and successively into corresponding studs 17, FIGS. 3, 4 and 5, effectively securing and mounting the anchor plate 73 and the complete security striker plate or unit 11 within the cut out portion of inner door jamb 15, FIG. 1.

Upright elongated fin 75, approximately up to an inch long, for illustration, extends at right angles to and rearwardly of anchor plate 73, and as assembled bears against outer door jamb 13. This completes the assembly of striker plate 11 with respect to the door rail as defined by inner and outer door jambs 13 and 15.

The lip 71 terminates in the upright elongated fin 77 which extends rearwardly of strike plate 53, and in the assembly in FIGS. 3, 4 and 5 bears against right angular flange 35 of hook plate 29. This relationship between hook plate 29 and the present door frame security striker plate 11 is further shown in the perspective view, FIG. 2.

Figure 6:
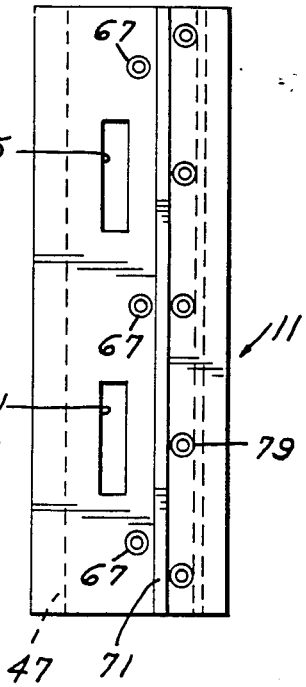
FIG. 6 is a side elevational view of the security striker plate shown in FIG. 2 illustrating the strike plate, door stop lip and anchor flange.

Within anchor plate 73 are a series of longitudinally spaced counter sunk apertures 79, FIG. 6, arranged in a row, adapted to receive the elongated safety screws 81, sometimes referred to as tamper proof safety screws. Their heads are so formed as not to receive a conventional screw driver, and be force assembled to the position shown in FIGS. 3, 4 and 5. The screws 81 are approximately 4" long, extend through the anchor plate 73, through corresponding apertures 83 in the hook plate and snugly into the 2×4's 17. This completes the assembly, mounting and anchorage security striker plate 11 within the door frame.

Fin 75 further functions as protection for the corresponding fasteners 81 to prevent unauthorized access thereto from the outside as by a crow bar or jimmey. The safety screws 81 are further stabilized against twisting or bending by their projection through the corresponding hook strip 29 before assembly into the corresponding 2×4's 17.

Similarly, the elongated fin 77 further protects the adjacent assembly screws 69 from any unauthorized exterior tampering. Here, also, the safety screws 69 project through elongated support portions of hook strip 29 and snugly into the corresponding studs 17, FIGS. 3, 4 and 5.

As providing further security for the security striker plate 11 there is shown in FIG. 2, 4 and 5 an elongate supplemental deadbolt 87 which is generally of T shape in cross section and is slidably positioned within a corresponding T shaped undercut slot 85 formed within the front face of mount plate 47. Handle 89 projects outwardly of deadbolt 87 and includes a shaft 91, FIG. 5, which extends through bore 93 in deadbolt 87, extends through the counterbore 95 and terminates in detent 97. In the assembly shown in FIG. 5 with the deadbolt 87 advanced to a door retaining position, detent 97 is nested within detent recess 99 within mount plate 47. Coiled compression spring 101 is nested within counterbore 95 and anchored at one end within said counterbore, adjacent bore 93. The other end of the spring 101 bears against detent 97 so the detent is normally biased into the locking position shown.

Deadbolt 87 has a retracted position, FIGS. 1 and 2, wherein the corresponding spring biased detent 97 is nested within a rearwardly spaced detent recess 99, within mount plate 47. In the retracted position of deadbolt 87 and in the advanced position, FIG. 5, the detent assembly including the coil spring 101 is effective for retaining the deadbolt 87 in both positions. With the deadbolt 87 advanced, FIGS. 4 and 5, it provides additional security in that deadbolt 87 overlies adjacent portions of door 39 to prevent unauthorized opening of the door.

As shown in FIGS. 1, 3, 4 and 5, the present door frame security striker plate 11 is insert within a portion of the side rail forming a part of the door jamb 13 and 15 and bears against its inner surface. In order to disengage detent 97 from its holding position, either with deadbolt 87 advanced or retracted, all that is necessary is to manually retract handle 89 outwardly against action of spring 101 until the detent 97 is removed from the detent recess 99.

The method of installing the present security striker plate 11 for a door frame comprises the following steps:

(1) Cutting out an enlarged opening, FIG. 1, within the door frame rail 13, 15, door stop 45, adjacent internal upright studs 17;

(2) Positioning the unit formed security striker plate 11 in the cut out opening so that the mount plate portion 47 of the striker plate bears against the interior of the door frame; the strike plate portion 53 bears against a right angular surface of the door frame; the anchor plate portion 73 bears against an interior surface of the door frame; and the door stop lip 71 rests within the door stop 45; and (3) Projecting securing fasteners 51, 69 and 81 successively through the mount plate 47, strike plate 53 and anchor plate 73 with the screws extending into and interlocked with the studs 17 and with the screws 69 and 81 supported and reinforced by their extension through the hook plate 29, for preventing the striker plate 11 from being dislodged with a force which could be reasonably expected such as a kick to the door.

The foregoing description is explanatory of one operative embodiment of the present invention. It is contemplated within the scope of the claims hereunder that there may be other embodiments which carry out the present invention.

Having described my invention reference should now be had to the following claims.

I claim:

1. A security striker plate for a locking means upon a door hinged within a door jamb, including an upright rail, a peripheral door stop and interior framing studs;

comprising an elongated mount plate inset within a portion of the upright rail and bearing against its inner surface; said mount plate being located in a plane which is parallel to the plane of the door when closed;

a first series of longitudinally spaced elongated first screws arranged in a pair of laterally spaced rows extending through said mount plate and into the framing studs for anchoring the mount plate thereto;

an elongated right angular apertured strike plate intergral with and extending from said mount plate bearing against a right angular surface of the upright rail and facing the door when closed;

a second series of longitudinally spaced elongated second screws arranged at right angles to said first screws extending through said strike plate and threaded into said studs;

an enlongated right angular door stop lip integral with and extending outwardly from one side of said strike plate in registry with and reinforcing the door stop;

an elongated anchor plate integral with and projecting from said door stop lip at right angles thereto, registering with an outer portion of the door jamb;

a third series of longitudinally spaced tamper proof third screws extending through said anchor plate and threaded into said studs, and extending parallel to said second screws;

a first elongated fin integral with and in registry with said door stop lip and extending rearwardly of said strike plate to prevent tampering with said second screws; and a second elongated fin integral with, extending along and projecting rearwardly of said anchor plate outwardly of and protecting said third screws from tampering;

said mount plate, door stop lip and second elongated fin being parallel to one another, said strike plate and said anchor being parallel, and said first elongated fin being parallel to said mount plate and to said second elongated fin.

2. In the security striker plate of claim 1, an elongated hook strip of L-shape configuration mounted upon and extending along one of said studs inwardly of said strike plate and anchor plate;

said hook strip having formed therein a row of longitudinally spaced apertures adapted to cooperatively receive said third screws;

said hook strip including a right angular spacer flange in registry with said strike plate having formed therethrough a corresponding series of longitudinally spaced apertures adapted to supportably receive said second screws;

said first fin supportably bearing against said hook strip.

3. In the security striker plate of claim 1, said locking means including a deadbolt assembly mounted upon said door adjacent said rail, including a deadbolt when advanced projected through an aperture in said striker plate;

said door stop lip protecting said deadbolt from tampering.

4. In the security striker plate of claim 1, said locking means including a latch bolt assembly mounted upon said door adjacent said rail, including a latch bolt when advanced projected through an aperture in said strike plate;

said door stop lip protecting said latch bolt from tampering.

5. In the security striker plate of claim 1, said locking means including a deadbolt lock assembly and a latch bolt assembly both mounted upon said door adjacent said rail, the deadbolt assembly including a deadbolt when advanced projected through an aperture in said striker plate said latch bolt assembly including;

a latch bolt when advanced projected through a corresponding aperture in said strike plate;

said door stop lip projecting said deadbolt and latch bolt from tampering.

6. In the security striker plate of claim 1, there being a transverse undercut T-slot in the face of said mount plate;

a deadbolt of complimentary shape slidably positioned within said slot, having a normally retracted position within said mount plate and an advanced position forwardly of said mount plate to overlie a portion of said door when closed; and a handle for sliding said deadbolt between said positions.

7. In the security striker plate of claim 6, and releasable detent means on said mount plate and deadbolt for releasably retaining said deadbolt in advanced and retracted positions.

8. In the security striker plate of claim 7, said releasable detent means including a retractable shaft on said handle slidable through a bore in said deadbolt;

a detent mounted upon said shaft nested within one of a pair of longitudinally spaced detent recesses in said mount plate;

said bore terminating in a counterbore receiving said detent; and a coil spring anchored in said counterbore and biasing said detent outwardly.

9. In the security striker plate of claim 1, said security striker plate being extruded from aluminum.

10. A security striker plate for a locking means upon a door hinged within a door jamb, including an upright rail, a peripheral door stop and interior framing studs;

comprising an elongated mount plate inset with a portion of the upright rail and bearing against its inner surface;

a series of longitudinally spaced elongated first screws arranged in a pair of laterally spaced rows extending through said mount plate and into the framing studs for anchoring the mount plate thereto;

an elongated right angular apertured strike plate integral with and extending from said mount plate bearing against a right angular surface of the upright rail and facing the door when closed;

a plurality of longitudinally spaced elongated second screws extending through said strike plate and threaded into said studs for anchoring the strike plate thereto;

an elongated right angular door stop lip integral with and extending outwardly fron said strike plate in registry with and reinforcing the door stop;

an elongated anchor plate integral with and projecting from said lip at right angles thereto, registering with an outer portion of the door jamb;

a series of longitudinally spaced tamper proof third screws extending through said anchor plate and threaded into said studs securing said anchor plate thereto;

a first elongated fin integral with and in registry with said door stop lip and extending rearwardly of said strike plate to prevent tampering with said second screws; and a second elongated fin integral with, extending along and projecting rearwardly of said anchor plate outwardly of and protecting said third screws from tampering;

said mount plate, door stop lip and second elongated fins being parallel to one another, said strike plate and said anchor being parallel, and said first elongated fin being parallel to said mount plate and to said door stop lip;

said elongated mount plate, strike plate, door stop lip, anchor plate and said first and second fins being of unitized construction and having generally the same length.

11. In the security striker plate of claim 1 wherein said elongated mount plate, strike plate, door stop lip, anchor plate and said first and second fins are of generally the same length.

* * * * *